US005172625A

United States Patent [19]

Latham

[11] Patent Number: 5,172,625

[45] Date of Patent: Dec. 22, 1992

[54] HYDRAULIC CYLINDER WITH LATERAL SUPPORT

[76] Inventor: Robert P. Latham, 280 SW. 32nd Ct., Fort Lauderdale, Fla. 33315

[21] Appl. No.: 787,666

[22] Filed: Nov. 4, 1991

[51] Int. Cl.[5] ..... F01B 7/20

[52] U.S. Cl. ..... 92/51; 92/110; 92/118; 92/165 R

[58] Field of Search ..... 92/51, 52, 53, 110, 92/111, 117 R, 117 A, 165 R

[56] References Cited

U.S. PATENT DOCUMENTS

| | | | |
|---|---|---|---|
| 3,045,649 | 7/1962 | Blatt | 92/117 R |
| 3,150,564 | 9/1964 | McMullen | 92/117 R |
| 3,335,642 | 8/1967 | Rosaen | 92/111 |
| 3,353,352 | 11/1967 | Gardner | 92/110 |
| 3,592,108 | 7/1971 | Rosaen | 92/110 |

FOREIGN PATENT DOCUMENTS

| | | | |
|---|---|---|---|
| 0086210 | 7/1981 | Japan | 92/117 A |
| 2024946 | 1/1980 | United Kingdom | 92/111 |

*Primary Examiner*—Thomas E. Denion
*Attorney, Agent, or Firm*—Alvin S. Blum

[57] ABSTRACT

A hydraulic piston and cylinder assembly is provided with an outer sleeve attached to the piston rod. The outer wall of the cylinder has a smooth wall with a circular cross section concentric with the inner bore of the cylinder. The outer sleeve has a smooth inner bore with a circular cross section concentric with the cylinder. The outer sleeve is arranged to slide along the outer wall of the cylinder to provide a sliding linear bearing that resists lateral loads that would otherwise be taken up by the piston and piston rod at their contacts with the cylinder. The sleeve distributes the lateral load over a greater surface area and supports the forces with a stronger structure than conventional assemblies. The sleeve, cylinder and piston have concentric circular cross sections to permit rotation about the central axis without binding. The sleeve has a lubricous plastic lining to enhance sliding contact with the outer wall of the cylinder.

7 Claims, 1 Drawing Sheet

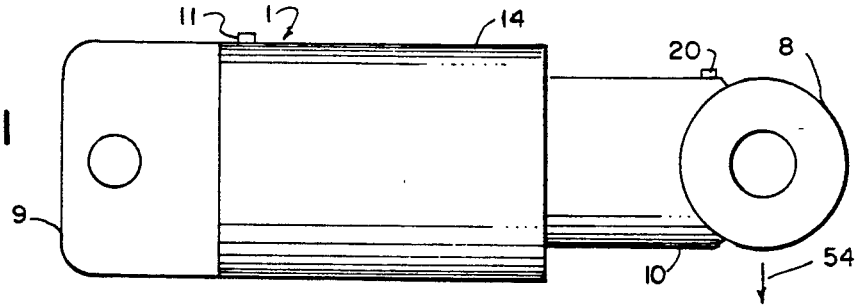
FIG. 1
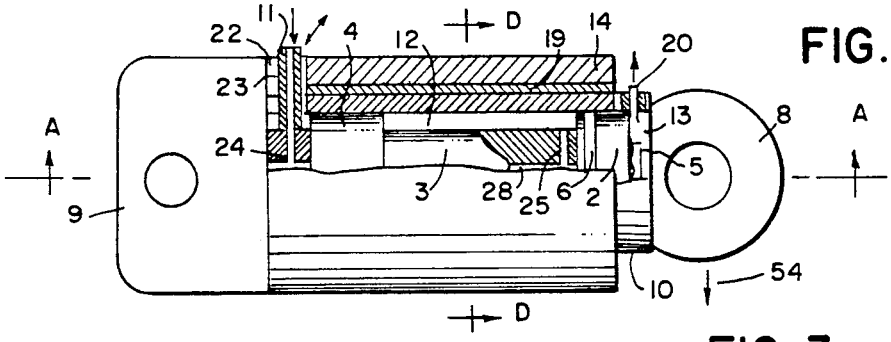
FIG. 2
FIG. 3
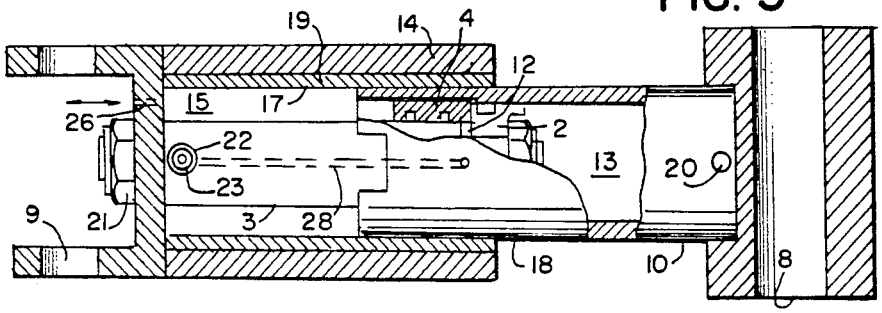
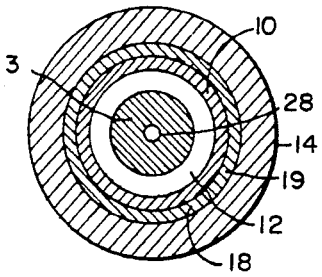
FIG. 5
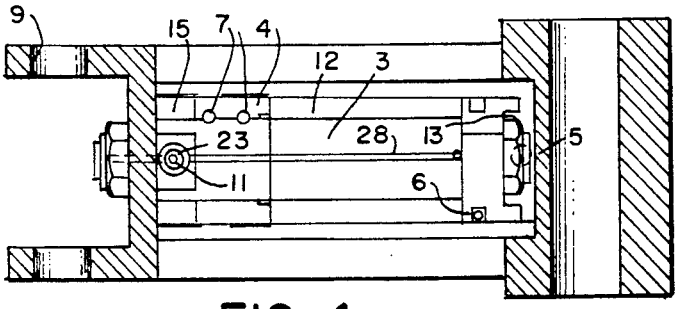
FIG. 4
FIG. 7
PRIOR ART
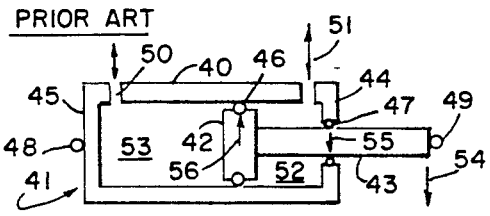
FIG. 6
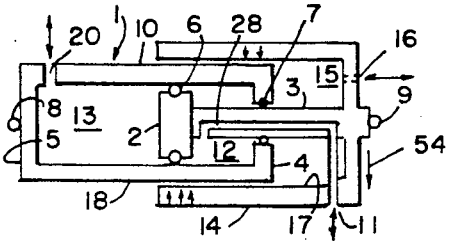

HYDRAULIC CYLINDER WITH LATERAL SUPPORT

BACKGROUND OF THE INVENTION

This invention relates to hydraulic piston and cylinder assemblies for affecting translatory to and fro motion, and more particularly to such an assembly constructed to resist forces that are transverse to the direction of motion of the piston.

In the steering of watercraft, a hydraulic cylinder and piston assembly is often employed to move a pivoting element such as an outboard motor or an outdrive for an inboard engine. The cylinder links a stationary point on the transom to a point on the pivoting element beyond the pivot axis. Hydraulic controls shorten or lengthen the cylinder assembly to pivot the element about the pivot axis. In the case of high power marine propulsion units, there may be forces as high as one thousand horsepower at the propeller of the pivoted element. On the water, these forces may be applied erratically in almost any direction. For example, when in straight forward motion, a rotating fully immersed propeller produces a resultant of forces that is in line with the keel. The lower blades produce a lateral force in one direction that are cancelled by the upper blades producing a lateral force in the opposite direction. However, when the propeller is lifted half way out of the water, the upper blades hit only air and provide no cancelling force. Consequently, the propulsion unit is subjected to a sudden strong lateral force. In order to withstand these lateral forces, a marine hydraulic cylinder assembly must be made very large and heavy, because the lateral forces put excessive stress on the assembly.

SUMMARY OF THE INVENTION

It is accordingly an object of the invention to provide a hydraulic piston and cylinder assembly that is resistant to lateral forces. It is another object to provide such an assembly in which the piston is free to rotate about the longitudinal axis of the cylinder to prevent binding. The cylinder of the invention has a circular inner wall and a concentric circular outer wall. A circular piston moves within the cylinder with a large diameter piston rod attached to the piston and sealingly extending through one of two end caps of the cylinder. Attached to the piston rod beyond the cylinder is a lateral support element in the form of an elongate member having a sturdy wall with a cylindrical bore concentric with the axis of the cylinder and providing a close sliding fit with the outer surface of the cylinder. One or both of the sliding surfaces is provided with a lubricous, wear-resistant material. This lateral support element cooperates with the outer wall of the cylinder to resist lateral forces that would otherwise be taken up by the piston, the piston seal and the cylinder rod seal or gland. Since all of the sliding surfaces are circular and concentric, the piston is free to rotate about the longitudinal axis of the cylinder without binding which is very useful in this application where the pivots at both ends of the cylinder assembly limit motion.

These and other objects, advantages and features of the invention will become more apparent when the detailed description is considered in conjunction with the drawings.

BRIEF DESCRIPTION OF THE DRAWINGS

FIG. 1 is a front elevation view of the invention with piston partially extended.

FIG. 2 is a front elevation view of the invention with piston retracted and portions broken away.

FIG. 3 is a sectional view, taken on line A—A of FIG. 2 with piston extended.

FIG. 4 is a sectional view, taken on line A—A of FIG. 2 with piston retracted.

FIG. 5 is a sectional view, taken on line D—D of FIG. 2.

FIG. 6 is a diagrammatic view of a conventional piston/cylinder assembly with lateral forces illustrated.

FIG. 7 is a diagrammatic view of the invention with lateral forces illustrated.

DETAILED DESCRIPTION OF PREFERRED EMBODIMENTS

Referring now first to FIG. 6, a hydraulic cylinder/-piston assembly 41 exemplary of the prior art is shown with one load connector 48 connected to one end of cylinder 40 that has end closures 45, 44. A piston 42 with sliding seal 46 slidably engages the inner wall of the cylinder, dividing the cylinder into a first chamber 52 and a second chamber 53 that are in fluid communication with hydraulic fluid ports 51 and 50, respectively. A piston rod 43 passes through sliding seal 47 in end closure 44 and connects the piston with a second load connector 49. By forcing fluid in and out of the chambers 52 and 53 the piston is moved back and forth in a straight line parallel to the long axis of the cylinder and the load connectors with loads are moved correspondingly. When a lateral load that is transverse to the long axis of the cylinder is applied to the piston relative to the cylinder as indicated by arrow 54, concentrated lateral forces are transferred to the piston rod/end closure seal 47 and the piston seal 46 at the point of contact with the cylinder as indicated by arrows 55 and 56. These concentrated forces may damage the structures at the points of contact.

Referring now to piston and cylinder assembly of the invention 1 shown in FIG. 7, a cylinder 10 is closed by end closures 5 and 4. A piston 2 has seal 6 for slidably sealing within the cylinder that divides the cylinder into a first sealed chamber 12 and a second sealed chamber 13. A piston rod 3 stretches from the piston, through a seal 7 at end closure 4, and out to a second load connector 9. Attached to the end of rod 3 is lateral support member 14 that has a circular bore 17 concentric with the circular outer wall 18 of the cylinder and slidingly engaged thereon. When a lateral force 54 is applied to the load connector 9, the forces are distributed to broad areas on the larger, outside diameter 18 of the cylinder by the larger and stronger support member 14, thereby sparing the piston, cylinder and seals from damage. The bearing surfaces all being circular and concentric, the piston rod and its connector are free to rotate about the cylinder axis without binding. A hydraulic fluid port 20 communicates with sealed fluid chamber 13, as in the prior art. However, access to sealed fluid chamber 12 cannot be achieved by conventional means because support member 14 slides past the cylinder wall. A bore hole 28 in piston rod 3 communicates with the chamber at one end and with a fluid connector 11 at another end. The chamber 15 that is exterior to the cylinder is vented at vent 16 to the environment to enhance free movement of the piston, otherwise, this would be a closed chamber that would stop movement of the piston.

Referring now to FIGS. 1-5, the hydraulic cylinder/-piston assembly 1 of the invention is shown in more detail in various views. A first load connector 8 welded to the end of cylinder 10 is forced toward second load connector clevis 9, which is welded to lateral support member 14, when hydraulic fluid is forced into first fluid chamber 12 through port 11. First chamber 12 is defined by the inner wall of cylinder 10, the outer surface of piston rod 3, the piston 2, and cylinder end closure 4 through which piston rod 3 is sealingly and slidingly engaged by O-ring seals 7. O-ring seal 6 seals the piston to the cylinder. Lateral support member 14 is joined to the threaded end of piston rod 3 by nut 21. A bearing liner 19, fabricated from a lubricous plastic, has a smooth inner bore 17 that slidingly engages the smooth, outer circular wall 18 of the cylinder to form a low friction translatory or linear bearing with free rotation about the long axis of the cylinder to prevent binding when the two load connector ends 8 and 9 twist relative to one another. Any lateral load, such as force indicated by arrow 54, will be absorbed by the linear bearing between lateral support member 14 and outer wall of cylinder 10. This has a larger diameter and a much greater length than the bearing surfaces within the cylinder, so that the load per unit area is greatly reduced. Furthermore, the structures supporting the bearing surfaces are also much larger. Consequently, the assembly of the invention can withstand much greater lateral loads, sudden shocks, and vibration then the prior art devices. Second sealed chamber 13, that opposes chamber 12, is defined by the inner wall of cylinder 10, the piston 2 and the end wall 5 to which the cylinder is welded in the connector 8. The pathway for hydraulic fluid from port 20 to sealed chamber 13 is a short direct hole through the wall of cylinder 10. The pathway from hydraulic fluid connection port 11 to sealed chamber 12 is more indirect since the support member 14 sweeps past the wall of the cylinder at that area corresponding to chamber 12. Port 11 is a pipe that extends through an oversize aperture 22 in the lateral support member 14 and is sealed to a first transverse hole 24 in the piston rod 3. The transverse hole 24 communicates with an elongate central bore 28 that extends down the rod to a point adjacent the piston 2, where it communicates with a second transverse bore 25 that opens into chamber 12. An exterior chamber 15 defined by the inner bore of the lateral support member 14, the outer end of the cylinder 10, and clevis 9 must be vented. The enlarged aperture 22 in lateral support member 14 through which pipe 11 passes provides for free passage of fluid to this chamber. Alternatively, aperture 26 may be provided to vent chamber 15.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A piston and cylinder assembly comprising:

a) a hollow cylindrical member with a long axis, an outer cylindrical surface, two ends and a cross section having inner and outer margins which are concentric circles, said cylindrical member provided with a first load-engaging means for engaging a load at a first end;

b) end closure means for closing opposite ends of the cylindrical member;

c) a piston with a circular cross-section arranged slidingly and sealingly within the cylindrical member so as to be able to move axially and to rotate about the axis therein while fluid-tightly engaging a bore surface of the cylindrical member;

d) a piston rod secured to said piston and stretching from said piston out of the cylindrical member through one of the end closure means at a second end of the cylindrical member and being able to be extended from, and retracted into said cylindrical member while fluid-tightly engaging said one of said end closure means, whereby two variable volume hydraulic chambers for hydraulic fluid are formed on opposite sides of said piston with said cylindrical member, a first chamber defined by said piston and said one of the end closure means and a second chamber defined by said piston and the other of the end closure means;

e) an elongate support member having a bore portion and a joint portion, said joint portion joined to a part of said piston rod which is outside of said cylindrical member, said support member having an elongate bore portion with a circular cross section arranged concentric with said long axis of said cylindrical member and slidably and non-sealingly engaging said outer cylindrical surface of said cylindrical member, to thereby provide a linear bearing means between support member and cylindrical member along said long axis and about said long axis for restraining non-coaxial relative motion between said support member and said cylindrical member, said bearing means having a length that is substantially equal to said outer cylindrical surface of said cylinder; and f) vent means for venting to the environment a space defined by said second end of said cylindrical member and said bore portion of said support member, said space arranged to be free of hydraulic fluid.

2. The piston and cylinder assembly according to claim 1 further comprising a second load-engaging means for engaging a load connected to said joint portion of said support member.

3. The piston and cylinder assembly according to claim 2 further comprising a solid, rigid, lubricous material applied to at least one of the two surfaces consisting of the bore of the support member and the outer diameter of said cylindrical member for enhanced sliding action therebetween.

4. The piston and cylinder assembly according to claim 3 further comprising fluid channel means extending from said first chamber into the piston rod and extending axially within the piston rod from a first point proximal the piston to a second point which is outside of said cylindrical member, said fluid channel means for introducing and withdrawing first chamber fluid without interference from said support member.

5. The piston and cylinder assembly according to claim 4 in which said piston rod is rigidly connected to said joint portion of said support member.

6. The piston and cylinder assembly according to claim 3 in which said lubricous material is affixed to the bore of said support member and the outer surface of said cylindrical member is provided with a smooth finish for slidingly cooperating with said lubricous material.

7. The piston and cylinder assembly according to claim 3, in which said solid, rigid, lubricous material is affixed to the outer surface of said cylindrical member and the bore of said support member is provided with a smooth surface for slidingly cooperating with said lubricous material.

* * * * *